US009075380B2

(12) United States Patent
Buzzelli

(10) Patent No.: US 9,075,380 B2
(45) Date of Patent: Jul. 7, 2015

(54) IMAGE TRANSFER SYSTEM HAVING PRE NIP WRAP

(75) Inventor: John Thomas Buzzelli, Walworth, NY (US)

(73) Assignee: Xerox Corporation, Norwalk, CT (US)

( * ) Notice: Subject to any disclaimer, the term of this patent is extended or adjusted under 35 U.S.C. 154(b) by 610 days.

(21) Appl. No.: 13/207,217

(22) Filed: Aug. 10, 2011

(65) Prior Publication Data

US 2013/0039681 A1 Feb. 14, 2013

(51) Int. Cl.
*G03G 15/06* (2006.01)
*G03G 15/20* (2006.01)
*G03G 15/00* (2006.01)

(52) U.S. Cl.
CPC ..... *G03G 15/754* (2013.01)

(58) Field of Classification Search
USPC ..... 399/313, 384, 388
See application file for complete search history.

(56) References Cited

U.S. PATENT DOCUMENTS 5,983,060 A * 11/1999 Namekata et al. ..... 399/297
7,242,894 B2 7/2007 Kuo et al.
7,653,331 B2 1/2010 Gross et al.
2012/0308286 A1* 12/2012 Porter et al. ..... 399/384

FOREIGN PATENT DOCUMENTS

JP 03179476 A * 8/1991
JP 08137153 A * 5/1996

* cited by examiner

*Primary Examiner* — David Gray
*Assistant Examiner* — Erika J Villaluna
(74) *Attorney, Agent, or Firm* — Ronald E. Prass, Jr.; Prass LLP

(57) ABSTRACT

An image transfer system includes an endless image bearing belt for carrying an image to be transferred to a web material; a first roll around which the image bearing belt travels; a second roll around which the image bearing belt travels; a biased transfer roll for supporting the web material such that the web material contacts the image bearing belt at a nip located at a nip location between the biased transfer roll and the first roll, and such that the image is transferred from the image bearing belt to the web material; and a pre nip roll for supporting the web material upstream of the nip. The image bearing belt wraps concavely around the first roll, and the first roll and the biased transfer roll are positioned relative to each other such that the web material wraps around a portion of the image bearing belt and the first roll prior to the web material entering the nip and prior to the image being subjected to an electric field.

20 Claims, 3 Drawing Sheets

IMAGE TRANSFER SYSTEM HAVING PRE NIP WRAP

BACKGROUND

The present disclosure relates generally to transferring images in image forming devices. More particularly, the present disclosure describes an apparatus, method, and system useful for transferring an image from an image bearing belt to a web material.

Image transfer systems that use photoconductive belts as the image bearing surface for building the image can use non pressure transfer nips employing corona devices for transferring the image to the substrate. A problem exists when trying to print on rough web substrates like webs with labels or perforations. Air breakdown at the transfer nip can cause image disturbance around label edges and perforations. Air breakdown refers to ionization of air caused by air within a field where the field exceeds the Paschen curve for air as described by Paschen's Law. The ions created by this ionization cause many different types of image disturbances as they react with the many charged particles and surfaces involved with electrophotography.

A pressure transfer system can be used to eliminate the air in the transfer nip which will significantly reduce break down and image disturbance. A transfer assist blade can be used, but does not provide enough force in the transfer nip to significantly eliminate the air gaps around heavier substrates with perforations and like what is encountered in label webs. Rolls that are electrically biased, called biased transfer rolls, can be used to provide transfer nip pressure and electric field for image transfer in systems that do not use photoconductive belts to significantly reduce the air in the transfer nip thus significantly reducing any image disturbances.

A problem with using a biased transfer roll with a photoconductive belt is that photoconductive belts can have a grounded layer which can cause a field between the biased transfer roll and the photoconductive belt in the area just before the transfer nip. This field can cause pre-nip breakdown and image disturbance which can range from graininess to heavy mottle, white spots, and large area deletions.

Using a biased transfer roll pressure nip may cause motion quality issues at the point of the photoconductive belt seam or possible arc through if the seam is not sufficiently insulated from the ground layer.

SUMMARY

Because favorable pre nip geometry is extremely difficult to design between two rolls in contact, adjustment of the web in the pre nip area is required to prevent breakdown and its associated defects. The disclosure describes the use of a pre nip wrap of the web material to which the image is ultimately transferred. The transfer nip geometry is maintained by the biased transfer roll, a drive roll, and a pre nip roll. The pre nip transfer field can cause air to break down between the biased transfer roll and the photoconductive belt in the area just before the transfer nip where the photoconductive belt comes into contact with the biased transfer roll. This is a common source of transfer related image disturbance in pressure transfer systems that do not take care to maintain specific geometric relationships between all of the components in the transfer system. Image disturbances due to the pre nip transfer field are eliminated by forming a pre-nip wrap of the web around the drive roll and photoconductive belt. This pre nip wrap greatly reduces the air gap between the web and photoconductive belt.

An image transfer system is provided. The system includes an endless image bearing belt for carrying an image to be transferred to a web material; a first roll around which the image bearing belt travels; a second roll around which the image bearing belt travels; a biased transfer roll for supporting the web material such that the web material contacts the image bearing belt at a nip located at a nip location between the biased transfer roll and the first roll, the nip being a transfer zone in which the image is subjected to an electric field in order to transfer the image from the image bearing belt to the web material; a pre nip roll for supporting the web material upstream of the nip; and a roll retracting mechanism that moves the biased transfer roll and the pre nip roll away from the image bearing belt while a seam in the image bearing belt passes through the nip location. The image bearing belt wraps concavely around the first roll, and the first roll and the biased transfer roll are positioned relative to each other such that the web material wraps around a portion of the image bearing belt and the first roll prior to the web material entering the nip and prior to the image being subjected to the electric field.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the present embodiments and further features and advantages thereof may be acquired by referring to the following description taken in conjunction with the accompanying drawings, wherein.

DETAILED DESCRIPTION

Figure 1:
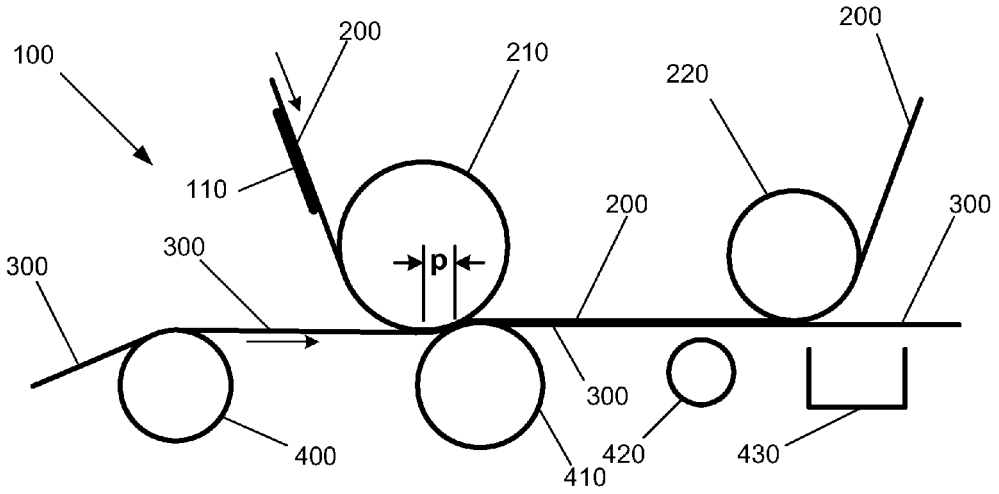
FIG. 1 is an exemplary schematic diagram of an image transfer system in accordance with embodiments of the disclosure.

Illustrative embodiments are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

The disclosed embodiments may include an image transfer system having an endless image bearing belt for carrying an image to be transferred to a web material; a first roll around which the image bearing belt travels; a second roll around which the image bearing belt travels; a biased transfer roll for supporting the web material such that the web material contacts the image bearing belt at a nip located at a nip location between the biased transfer roll and the first roll, the nip being a transfer zone in which the image is subjected to an electric field in order to transfer the image from the image bearing belt to the web material; a pre nip roll for supporting the web material upstream of the nip; and a roll retracting mechanism that moves the biased transfer roll and the pre nip roll away from the image bearing belt while a seam in the image bearing belt passes through the nip location, wherein the image bearing belt wraps concavely around the first roll, and the first roll and the biased transfer roll are positioned relative to each other such that the web material wraps around a portion of the image bearing belt and the first roll prior to the web material entering the nip and prior to the image being subjected to the electric field.

The disclosed embodiments may include an imaging system having a housing; an image transfer system located in the housing and having an endless image bearing belt for carrying an image to be transferred to a web material; a first roll around which the image bearing belt travels; a second roll around which the image bearing belt travels; a biased transfer roll for supporting the web material such that the web material contacts the image bearing belt at a nip located at a nip location between the biased transfer roll and the first roll, the nip being a transfer zone in which the image is subjected to an electric field in order to transfer the image from the image bearing belt to the web material; a pre nip roll for supporting the web material upstream of the nip; and a roll retracting mechanism that moves the biased transfer roll and the pre nip roll away from the image bearing belt while a seam in the image bearing belt passes through the nip location, wherein the image bearing belt wraps concavely around the first roll, and the first roll and the biased transfer roll are positioned relative to each other such that the web material wraps around a portion of the image bearing belt and the first roll prior to the web material entering the nip and prior to the image being subjected to the electric field; an image producing section that produces the image and places the image on the image bearing belt; and a web input for feeding the web material into the image transfer system.

The disclosed embodiments may include a method of transferring an image from an endless image bearing belt to a web material, the method including rotating the image bearing belt around a first roll and a second roll; guiding the web material over a pre nip roll and a biased transfer roll such that the web material contacts the image bearing belt at a nip located at a nip location between the biased transfer roll and the first roll, the nip being a transfer zone in which the image is subjected to an electric field in order to transfer the image from the image bearing belt to the web material; positioning the first roll and the biased transfer roll relative to each other such that the web material wraps around a portion of the image bearing belt and the first roll prior to the web material entering the nip and prior to the image being subjected to the electric field; and moving the biased transfer roll and the pre nip roll away from the image bearing belt with a roll retracting mechanism while a seam in the image bearing belt passes through the nip location, wherein the image bearing belt is wrapped concavely around the first roll prior to entering the nip.

In photoconductive belt systems, a transfer field is created between a grounded layer of the photoconductive belt and a biased transfer roll. Because favorable pre nip geometry is very difficult to design between two rolls in contact, adjustment of the paper web in the pre nip is required to prevent pre-nip breakdown and its associated defects. By providing a pre nip roll prior to the transfer nip, the web can be brought into intimate contact with the photoconductive belt (and the image) prior to being subjected to the electric field in the transfer zone (the nip).

In continuous feed applications, the inter-image distance must remain constant on the web in order to make finishing/cutting feasible. For this reason, the web should be able to move away from the photoconductive belt, reversed when the un-imaged belt seam reaches the transfer zone, then moved back in when images start again. A detack idler roll can be used to prevent the web from contacting a detack corotron (or other features) when the biased transfer roll and pre nip roll move away from the photoconductive belt when the belt seam is in the transfer nip.

FIG. 1 shows an example of an image transfer system 100 in accordance with embodiments of the disclosure. In FIG. 1, an image 110 is transferred from an image bearing belt 200 to a web of material 300. The web can be a paper or other material that can be cut into a final printed product. Image bearing belt 200 is, in this example, an endless belt that is wrapped around a plurality of rolls, two of which are shown in FIG. 1. Image bearing belt 200 is wrapped around a drive roll 210 and a stripper roll 220.

Web 300 comes from the left of FIG. 1 and travels over a pre nip roll 400 and a biased transfer roll 410 before exiting FIG. 1 to the right. Image bearing belt 200 comes into contact with web 300 in the pre-transfer nip area at a point where web 300 begins to wrap drive roll 210 in a concave manner just before biased transfer roll 410, wraps biased transfer roll 410 in a convex manner, and remains in contact with web 300 until just after stripper roll 220. In embodiments, image bearing belt 200 can wrap drive roll 210 along a distance of between approximately 1 mm and 5 mm prior to the transfer nip. In embodiments, image bearing belt 200 can wrap drive roll 210 along a distance of between approximately 2 mm and 4 mm prior to the transfer nip. In embodiments, image bearing belt 200 does not wrap biased transfer roll 410 after the transfer nip. In embodiments, image bearing belt 200 wraps biased transfer roll 410 after the transfer nip. These ranges are not exclusive, but are examples of appropriate ranges.

While relative hardness of the rolls can be different in different embodiments, in embodiments drive roll 210 is a somewhat firm rubberized roll and biased transfer roll 410 is a somewhat firm foam material. In embodiments, drive roll 210 is more firm than biased transfer roll 410.

FIG. 1 shows image 110 on the face of image bearing belt 200 prior to image bearing belt 200 coming into contact with web 300. During the contact between image bearing belt 200 and web 300, image 110 is transferred to web 300 as it moves through the transfer nip comprised of drive roll 210, image bearing belt 200, web 300, and biased transfer roll 410 and is later fixed to web 300 in a subsequent operation.

The relative positions of pre nip roll 400, drive roll 210, and biased transfer roll 410 cause web 300 to wrap around image bearing belt 200 and drive roll 210 prior to the nip between drive roll 210 and biased transfer roll 410. This wrap is called the pre nip wrap and occurs in the location designated by the letter "p" in FIG. 1. The pre nip wrap greatly reduces the air gap between image bearing belt 200 and web 300 prior to the transfer field. This greatly reduces, or eliminates, image disturbances caused by the transfer field because image bearing belt 200 and web 300 are in contact at the point the transfer field begins. By having image bearing belt 200 and web 300 in contact before the transfer field begins, there is no air gap across which parts of image 110 can jump before the image bearing belt 200 and web 300 are in proper alignment relative to each other.

Figure 2:
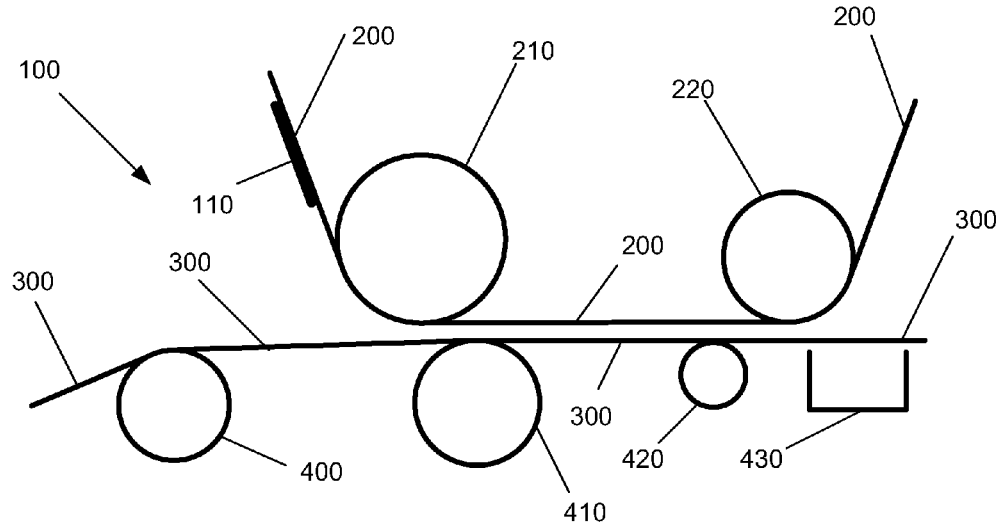
FIG. 2 is an exemplary schematic diagram of the system shown in FIG. 1.

A continuous belt such as image bearing belt 200 can have a seam at which one end of the belt is joined to the other end of the belt. The seam is usually thicker or otherwise dissimilar to the main portion of the belt and can be inappropriate for carrying the image. As a result, the web can be moved away from the image bearing belt, reversed when the un-imaged belt seam reaches the transfer zone, then moved back in when images start again. FIG. 1 shows image transfer system 100 in the position at which web 300 is in contact with image bearing belt 200. FIG. 2 shows image transfer system 100 in a position at which web 300 is moved away from image bearing belt 200. In FIG. 2, at least biased transfer roll 410 is moved away from drive roll 210 so that web 300 can lose contact with image bearing belt 200. In embodiments, pre nip roll 400 also moves (downward in FIG. 2) to facilitate web 300 moving away from image bearing belt 200.

FIGS. 1 and 2 show a detack corotron 430 that reduces or eliminates the electrical field between image bearing belt 200 and web 300 as they separate. When the system is moved into the position shown in FIG. 2, care must be taken to ensure that web 300 does not come into contact with detack corotron 430. A detack idler roll 420 is provided to support web 300 and insure that it does not contact detack corotron 430 when web 300 is moved away from image bearing belt 300.

Figure 3:
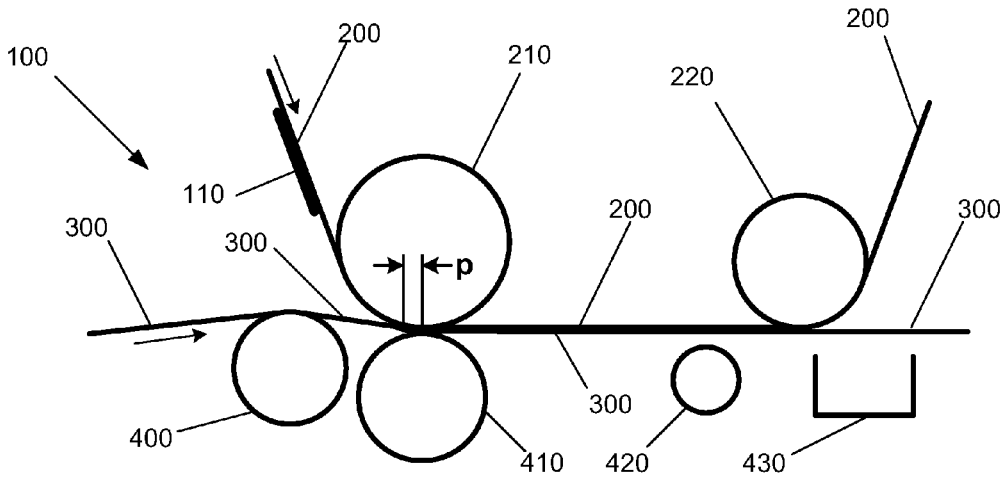
FIG. 3 is an exemplary schematic diagram of an image transfer system in accordance with embodiments of the disclosure.

FIG. 3 shows an example of an image transfer system where web 300 and image bearing belt 200 do not wrap biased transfer roll 410 after the transfer nip. This geometry can make it easier for web 300 to be retracted from image bearing belt 200.

Figure 4:
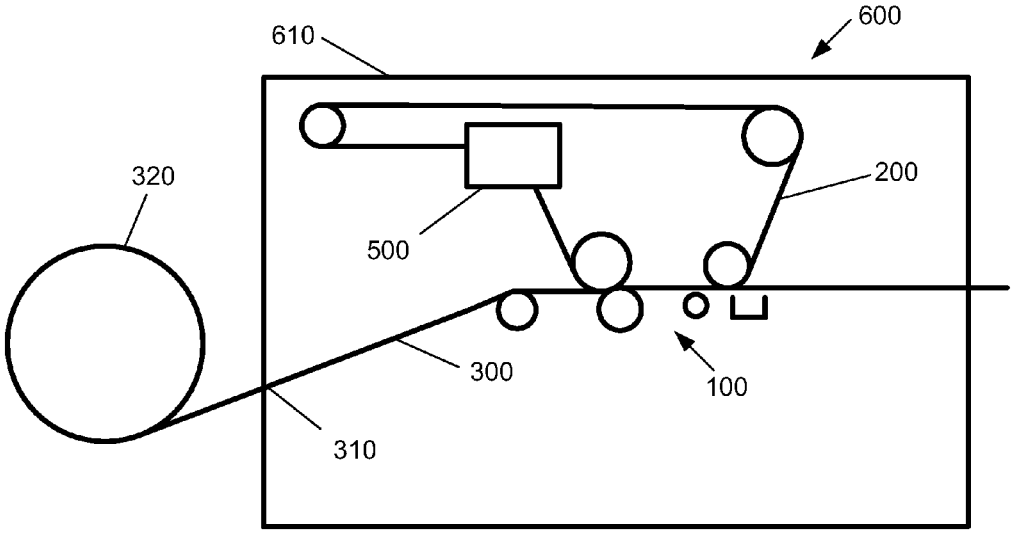
FIG. 4 is an exemplary schematic diagram of an imaging system in accordance with embodiments of the disclosure.

FIG. 4 shows an example of an imaging system 600 in accordance with embodiments of the disclosure. Imaging system 600 includes image transfer system 100 located in a housing 610. Imaging system 600 also has a web input that feeds web 300 into housing 610. Web 300 is supplied to imaging system 600 in this example on a web supply roll 320. The image is produced in an image producing section 500 and transferred to image bearing belt 200.

Figure 5:
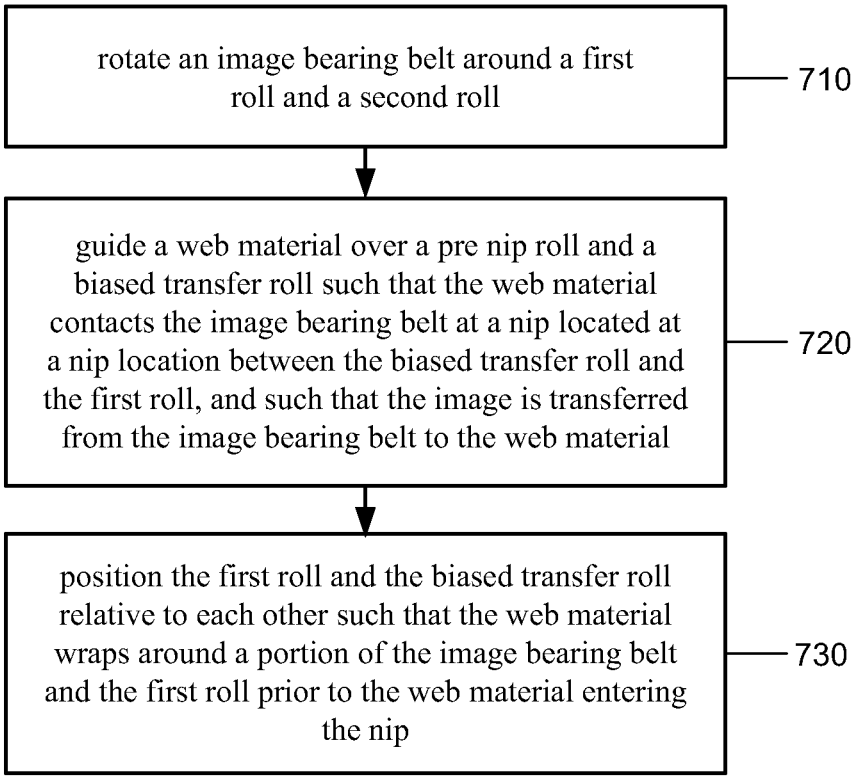
FIG. 5 shows a method in accordance with embodiments of the disclosure.

FIG. 5 shows an example of a method in accordance with embodiments of the disclosure. In 710, an image bearing belt is rotated around a first roll and a second roll. In 720, the web material is guided over a pre nip roll and a biased transfer roll such that the web material contacts the image bearing belt at a nip located at a nip location between the biased transfer roll and the first roll, and such that the image is transferred from the image bearing belt to the web material. In 730, the first roll and the biased transfer roll are positioned relative to each other such that the web material wraps around a portion of the image bearing belt and the first roll prior to the web material entering the nip.

Although the above description is directed toward image transfer systems used in xerographic printing, it will be understood that the teachings and claims herein can be applied to any treatment of marking material on a medium. For example, the marking material can be toner, liquid or gel ink, and/or heat- or radiation-curable ink; and/or the medium can utilize certain process conditions, such as temperature, for successful printing. The process conditions, such as heat, pressure and other conditions that are desired for the treatment of ink on media in a given embodiment may be different from the conditions that are suitable for xerographic printing.

As used herein, the term "imaging system" encompasses any apparatus that performs a print outputting function for any purpose. Such apparatuses can include, e.g., a digital copier, bookmaking machine, multifunction machine, and the like. The imaging system can use various types of solid and liquid marking materials, including toner and inks (e.g., liquid inks, gel inks, heat-curable inks and radiation-curable inks), and the like. The printing apparatuses can use various thermal, pressure and other conditions to treat the marking materials and form images on media.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. An image transfer system comprising:

an endless image bearing belt for carrying an image to be transferred to a web material;

a first roll around which the image bearing belt travels;

a second roll around which the image bearing belt travels;

a biased transfer roll for supporting the web material such that the web material contacts the image bearing belt at a nip located at a nip location between the biased transfer roll and the first roll, the nip being a transfer zone in which the image is subjected to an electric field in order to transfer the image from the image bearing belt to the web material;

a pre nip roll for supporting the web material upstream of the nip: and a roll retracting mechanism that moves the biased transfer roll and the pre nip roll away from the image bearing belt while a seam in the image bearing belt passes through the nip location, wherein the image bearing belt wraps concavely around the first roll prior to entering the nip, the first roll and the biased transfer roll are positioned relative to each other such that the web material wraps around a portion of the image bearing belt and the first roll prior to the web material entering the nip and prior to the image being subjected to the electric field; and a detack idler roll that prevents the web material from contacting a detack corotron when the roll retracting mechanism moves the biased transfer roll and the pre nip roll away from the image bearing belt.

2. The system of claim 1, wherein the image bearing belt is a photoconductive image bearing belt.

3. The system of claim 2, wherein the first roll is a drive roll of the image bearing belt.

4. The system of claim 1, wherein the first roll is a drive roll of the image bearing belt.

5. The system of claim 1, wherein the roll retracting mechanism is cam driven and synchronized with rotation of the image bearing belt.

6. The system of claim 1, wherein the image bearing belt wraps convexly around the biased transfer roll after the image bearing belt wraps concavely around the first roll.

7. The system of claim 1, wherein the web material wraps around a portion of the image bearing belt and the first roll for a distance of between 2 mm and 4 mm prior to the web material entering the nip.

8. An imaging system, comprising:

a housing;

an image transfer system located in the housing and having an endless image bearing belt for carrying an image to be transferred to a web material;

a first roll around which the image bearing belt travels;

a second roll around which the image bearing belt travels;

a biased transfer roll for supporting the web material such that the web material contacts the image bearing belt at a nip located at a nip location between the biased transfer roll and the first roll, the nip being a transfer zone in which the image is subjected to an electric field in order to transfer the image from the image bearing belt to the web material;

a pre nip roll for supporting the web material upstream of the nip; and a roll retracting mechanism that moves the biased transfer roll and the pre nip roll away from the image bearing belt while a seam in the image bearing belt passes through the nip location, wherein the image bearing belt wraps concavely around the first roll prior to entering the nip, and the first roll and the biased transfer roll are positioned relative to each other such that the web material wraps around a portion of the image bearing belt and the first roll prior to the web material entering the nip and prior to the image being subjected to the electric field;

an image producing section that produces the image and places the image on the image bearing belt;

a web input for feeding the web material into the image transfer system; and a detack idler roll that prevents the web material from contacting a detack corotron when the roll retracting mechanism moves the biased transfer roll and the pre nip roll away from the image bearing belt.

9. The system of claim 8, wherein the image bearing belt is a photoconductive image bearing belt.

10. The system of claim 9, wherein the first roll is a drive roll of the image bearing belt.

11. The system of claim 8, wherein the first roll is a drive roll of the image bearing belt.

12. The system of claim 8, wherein the roll retracting mechanism is cam driven and synchronized with rotation of the image bearing belt.

13. The system of claim 8, wherein the image bearing belt wraps convexly around the biased transfer roll after the image bearing belt wraps concavely around the first roll.

14. The system of claim 8, wherein the web material wraps around a portion of the image bearing belt and the first roll for a distance of between 2 mm and 4 mm prior to the web material entering the nip.

15. A method of transferring an image from an endless image bearing belt to a web material, the method comprising:

rotating the image bearing belt around a first roll and a second roll;

guiding the web material over a pre nip roll and a biased transfer roll such that the web material contacts the image bearing belt at a nip located at a nip location between the biased transfer roll and the first roll, the nip being a transfer zone in which the image is subjected to an electric field in order to transfer the image from the image bearing belt to the web material;

positioning the first roll and the biased transfer roll relative to each other such that the web material wraps around a portion of the image bearing belt and the first roll prior to the web material entering the nip and prior to the image being subjected to the electric field;

moving the biased transfer roll and the pre nip roll away from the image bearing belt with a roll retracting mechanism while a seam in the image bearing belt passes through the nip location, wherein the image bearing belt is wrapped concavely around the first roll prior to entering the nip, and supporting the web material with a detack idler roll to prevent the web material from contacting a detack corotron when the roll retracting mechanism moves the biased transfer roll and the pre nip roll away from the image bearing belt.

16. The method of claim 15, wherein the image bearing belt is a photoconductive image bearing belt.

17. The method of claim 16, wherein the first roll is a drive roll of the image bearing belt.

18. The method of claim 15, wherein the roll retracting mechanism is cam driven and synchronized with rotation of the image bearing belt.

19. The method of claim 15, wherein the image bearing belt is wrapped convexly around the biased transfer roll after the image bearing belt is wrapped concavely around the first roll.

20. The method of claim 15, wherein the web material is wrapped around a portion of the image bearing belt and the first roll for a distance of between 2 mm and 4 mm prior to the web material entering the nip.

* * * * *